US010378339B2

(12) United States Patent
Costa De Oliveira et al.

(10) Patent No.: US 10,378,339 B2
(45) Date of Patent: Aug. 13, 2019

(54) METHOD AND APPARATUS FOR CONTROLLING WELLBORE OPERATIONS

(71) Applicant: Saudi Arabian Oil Company, Dhahran (SA)

(72) Inventors: Victor Carlos Costa De Oliveira, Dhahran (SA); Ossama Sehsah, Dhahran (SA); Mario Augusto Rivas Martinez, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/807,314

(22) Filed: Nov. 8, 2017

(65) Prior Publication Data

US 2019/0136688 A1 May 9, 2019

(51) Int. Cl.
*E21B 47/12* (2012.01)

(52) U.S. Cl.
CPC ..... *E21B 47/122* (2013.01); *E21B 47/124* (2013.01)

(58) Field of Classification Search
CPC ..... E21B 47/122
USPC ..... 340/854.6
See application file for complete search history.

(56) References Cited

U.S. PATENT DOCUMENTS

| | | | |
|---|---|---|---|
| 1,812,044 | A | 6/1931 | Grant |
| 3,335,801 | A | 8/1967 | Wilsey |
| 3,557,875 | A | 1/1971 | Solum et al. |
| 4,058,163 | A | 11/1977 | Yandell |
| 4,384,625 | A | 5/1983 | Roper et al. |
| 4,399,873 | A | 8/1983 | Lindsey, Jr. |
| 4,458,761 | A | 7/1984 | Van Vreeswyk |
| 4,482,014 | A | 11/1984 | Allwin et al. |
| 4,646,842 | A | 3/1987 | Arnold et al. |
| 4,674,569 | A | 6/1987 | Revils et al. |
| 4,681,159 | A | 7/1987 | Allwin et al. |
| 4,693,328 | A | 9/1987 | Furse et al. |
| 4,852,654 | A | 8/1989 | Buckner |
| 4,855,820 | A | 8/1989 | Barbour |
| 4,944,348 | A | 7/1990 | Whiteley et al. |
| 4,993,493 | A | 2/1991 | Arnold |
| 5,152,342 | A | 10/1992 | Rankin et al. |
| 5,390,742 | A | 2/1995 | Dines et al. |

(Continued)

FOREIGN PATENT DOCUMENTS

| | | |
|---|---|---|
| CN | 204177988 | 2/2015 |
| EP | 377234 | 10/1989 |

(Continued)

OTHER PUBLICATIONS

International Search Report and Written Opinion issued in International Application No. PCT/US2018/059167 dated Feb. 19, 2019, 14 pages.

(Continued)

*Primary Examiner* — Santiago Garcia
(74) *Attorney, Agent, or Firm* — Fish & Richardson P.C.

(57) ABSTRACT

Method and apparatus for controlling wellbore operations include a wellbore communication system comprising: a control sub-assembly with a first control unit, a second control unit, one or more downhole sub-assemblies interchangeably mounted on and carried by a bottom hole assembly, each downhole sub-assembly configured to wirelessly send and receive signals from the second control unit.

12 Claims, 6 Drawing Sheets

(56) References Cited

U.S. PATENT DOCUMENTS 5,947,213 A * 9/1999 Angle ..... E21B 4/18 166/250.01
6,009,948 A 1/2000 Flanders et al.
RE36,556 E 2/2000 Smith
6,152,221 A 11/2000 Carmicheal et al.
6,163,257 A 12/2000 Tracy
6,234,250 B1 5/2001 Green et al.
6,378,628 B1 4/2002 McGuire et al.
6,527,066 B1 3/2003 Rives
6,550,534 B2 4/2003 Brett
6,577,244 B1 6/2003 Clark et al.
6,662,110 B1 12/2003 Bargach et al.
6,684,953 B2 2/2004 Sonnier
6,691,779 B1 2/2004 Sezginer et al.
6,739,398 B1 5/2004 Yokley et al.
6,752,216 B2 6/2004 Coon
6,873,267 B1 3/2005 Tubel et al.
6,899,178 B2 5/2005 Tubel
6,938,698 B2 9/2005 Coronado
7,219,730 B2 5/2007 Tilton et al.
7,228,902 B2 6/2007 Oppelt
7,243,735 B2 7/2007 Koederitz et al.
7,252,152 B2 8/2007 LoGiudice et al.
7,278,492 B2 10/2007 Braddick
7,419,001 B2 9/2008 Broussard
7,581,440 B2 9/2009 Meek
7,654,334 B2 2/2010 Manson
7,665,537 B2 2/2010 Patel et al.
7,677,303 B2 3/2010 Coronado
7,938,192 B2 5/2011 Rytlewski
7,940,302 B2 5/2011 Mehrotra et al.
8,028,767 B2 10/2011 Radford et al.
8,102,238 B2 1/2012 Golander et al.
8,191,635 B2 6/2012 Buske et al.
8,237,585 B2 8/2012 Zimmerman
8,334,775 B2 12/2012 Tapp et al.
8,424,605 B1 4/2013 Schultz et al.
8,448,724 B2 5/2013 Buske et al.
8,469,084 B2 6/2013 Clark et al.
8,528,668 B2 9/2013 Rasheed
8,540,035 B2 9/2013 Xu et al.
8,750,513 B2 6/2014 Renkis
8,789,585 B2 7/2014 Leising et al.
8,800,655 B1 8/2014 Bailey
8,833,472 B2 9/2014 Hay
8,919,431 B2 12/2014 Lott
8,925,213 B2 1/2015 Sallwasser
8,991,489 B2 3/2015 Redlinger et al.
9,051,792 B2 6/2015 Herberg et al.
9,091,148 B2 7/2015 Moflitt et al.
9,121,255 B2 9/2015 Themig et al.
9,140,100 B2 9/2015 Daccord et al.
9,157,294 B2 10/2015 Kleppa et al.
9,187,959 B2 11/2015 Treviranus et al.
9,208,676 B2 12/2015 Fadell et al.
9,341,027 B2 5/2016 Radford et al.
9,494,003 B1 * 11/2016 Carr ..... E21B 23/02
9,506,318 B1 11/2016 Brunet
9,546,536 B2 1/2017 Schultz et al.
2002/0148607 A1 10/2002 Pabst
2003/0001753 A1 1/2003 Cernocky et al.
2004/0060741 A1 4/2004 Shipalesky et al.
2004/0156264 A1 8/2004 Gardner et al.
2005/0273302 A1 12/2005 Huang et al.
2006/0081375 A1 4/2006 Ruttley
2006/0086497 A1 4/2006 Ohmer et al.
2006/0107061 A1 5/2006 Holovacs
2006/0260799 A1 11/2006 Broussard
2006/0290528 A1 12/2006 MacPherson et al.
2007/0057811 A1 3/2007 Mehta
2007/0107911 A1 5/2007 Miller et al.
2007/0187112 A1 8/2007 Eddison et al.
2007/0261855 A1 11/2007 Brunet
2008/0041631 A1 2/2008 Vail, III
2008/0115574 A1 5/2008 Meek
2009/0045974 A1 2/2009 Patel
2009/0050333 A1 * 2/2009 Smith ..... E21B 34/10 166/375
2009/0114448 A1 5/2009 Laird et al.
2009/0223670 A1 9/2009 Snider
2009/0289808 A1 11/2009 Prammer
2010/0097205 A1 4/2010 Script
2010/0101786 A1 4/2010 Lovell et al.
2010/0212891 A1 8/2010 Stewart et al.
2010/0212900 A1 8/2010 Eddison et al.
2010/0212901 A1 8/2010 Buytaert
2010/0258298 A1 10/2010 Lynde et al.
2010/0282511 A1 11/2010 Maranuk et al.
2011/0067884 A1 3/2011 Burleson et al.
2011/0073329 A1 3/2011 Clemens et al.
2011/0100645 A1 * 5/2011 Yapici ..... E21B 23/04 166/375
2011/0127044 A1 6/2011 Radford et al.
2011/0147014 A1 6/2011 Chen et al.
2011/0240302 A1 10/2011 Coludrovich, III
2011/0266004 A1 11/2011 Hallundbaek et al.
2012/0085540 A1 4/2012 Heijnen
2012/0175135 A1 7/2012 Dyer et al.
2012/0241154 A1 9/2012 Zhou
2012/0247767 A1 10/2012 Themig et al.
2012/0307051 A1 12/2012 Welter
2012/0312560 A1 12/2012 Bahr et al.
2013/0128697 A1 * 5/2013 Contant ..... E21B 17/028 367/81
2013/0153245 A1 6/2013 Knobloch et al.
2013/0186645 A1 7/2013 Hall
2014/0060844 A1 3/2014 Barbour et al.
2014/0083769 A1 3/2014 Moriarty et al.
2014/0090898 A1 4/2014 Moriarty et al.
2014/0126330 A1 5/2014 Shampine et al.
2014/0139681 A1 5/2014 Jones, Jr. et al.
2014/0166367 A1 6/2014 Campbell et al.
2014/0172306 A1 * 6/2014 Brannigan ..... E21B 47/00 702/13
2014/0208847 A1 * 7/2014 Baranov ..... G01D 11/24 73/431
2015/0027706 A1 1/2015 Symms
2015/0090459 A1 4/2015 Cain et al.
2015/0152713 A1 6/2015 Garcia et al.
2015/0176362 A1 6/2015 Prieto et al.
2015/0267500 A1 9/2015 Van Dongen et al.
2015/0308203 A1 * 10/2015 Lewis ..... E21B 47/06 175/48
2016/0160578 A1 6/2016 Lee
2016/0215612 A1 7/2016 Morrow
2016/0230508 A1 8/2016 Jensen
2016/0237764 A1 8/2016 Jellison et al.
2016/0237768 A1 8/2016 Jamison et al.
2016/0356152 A1 * 12/2016 Croux ..... E21B 47/14
2017/0074071 A1 3/2017 Tzallas et al.
2018/0030810 A1 * 2/2018 Saldanha ..... E21B 34/06

FOREIGN PATENT DOCUMENTS

EP 618345 10/1994
EP 2157278 2/2010
EP 2692982 5/2014
EP 2835493 2/2015
GB 2157743 10/1985
GB 2261238 12/1993
GB 2460096 11/2009
GB 2470762 12/2010
WO 2003058545 7/2003
WO 2011038170 3/2011
WO 2011095600 8/2011
WO 2011159890 12/2011
WO 2016144345 9/2016

OTHER PUBLICATIONS

Offshore, "Completions Technology: Large monobore completions prevent high-volume gas well flow restrictions", Dec. 1, 2001,

(56) References Cited

OTHER PUBLICATIONS retrieved from the internet: • http://www.offshore-mag.com/articles/print/volume-61/issue-12/news/completions-technology-large-monobore-completions-prevent-high-volume-gas-well-flow-restrictions.html, 9 pages.

Engineers Edge—ACME Stub Threads Size Designation Table Chart, retrieved from the internet at: http://www.engineersedge.com/hardware/acme-stub-thread.htm, retrieved Feb. 27, 2017, 2 pages.

Engineering Innovation Worldwide, TIW XPAK Liner Hanger System brochure, 2015 TIW Corporation, Houston TX , TIW0001D Jun. 2015, retrieved form the internet at: http://www.tiwoiltools.com/Images/Interior/downloads/tiw_xpak_brochure.pdf, 4 pages.

Mi Swaco: A Schlumberger Company, "Intelligent Fluids Monitoring System," available on or before Mar. 11, 2015, [retrieved May 1, 2018] retrieved from URL: <https://www.slb.com/resources/other_resources/brochures/miswaco/intelligent_fluids_monitoring_brochure.aspx>, 8 pages.

* cited by examiner

METHOD AND APPARATUS FOR CONTROLLING WELLBORE OPERATIONS

TECHNICAL FIELD

This disclosure relates to controlling drilling and other wellbore operations.

BACKGROUND

Wellbores can be drilled into geologic formations for a variety of reasons, such as, for example, hydrocarbon production, fluid injection, or water production. During wellbore drilling, a variety of tasks may need to be performed, each requiring different tools to be sent downhole. The term workover refers to any kind of wellbore intervention that necessitates, for example, the expensive process of removing and replacing a drill string, an operation that requires considerable time and expense.

SUMMARY

The technology relates to a downhole wellbore communication tool that provides wireless communication between downhole well operation tools and the surface. The technology can be used for downhole equipment (for example, drilling, completion, and workover equipment) that can be accessed by Wi-Fi communication. The tool passes information from downhole well operation tools to the surface and passes signals and commands to the downhole well operation tools. The communication tool is compact and can be mounted, for example, to a bottom hole assembly or drill string.

Some communication tools include a master control unit and a second (or auxiliary) control unit. The master control unit includes a processor with a transmitter and a receiver, and is coupled to a memory device. The second control unit also includes a processor with a transmitter and a receiver, and is coupled to a memory device. The processors of both units are powered by a stand-alone power source, for example, a lithium battery. In addition to receiving and transmitting data between the downhole well operation tools and the surface, each processor can deliver a full diagnostic of the well tools in real time and can identify points of failure.

In one aspect, wellbore communication systems include: a control sub-assembly including: a first control unit including a first processor, a first transmitter, a first receiver and a first memory, the first control unit operable to send and receive wireless signals from the surface; a second control unit including a second processor, a second transmitter, a second receiver and a second memory, the second control unit operable to send and receive wireless signals from the first control unit; and one or more downhole sub-assemblies interchangeably mounted on and carried by a bottom hole assembly, each of the one or more downhole sub-assembly configured to wirelessly send and receive signals from the second control unit. The first control unit is configured to organize information received from the one or more downhole sub-assemblies, organize the information in a standard telemetry sequence, and send it to the surface.

In one aspect, methods of controlling wellbore operations include: receiving, by a first control unit deployed within a wellbore and from a surface of the wellbore, instructions to perform operations within the wellbore; transmitting, by the first control assembly, at least a portion of the instructions to a second control unit downhole of the first control unit; receiving, by the second control unit, instructions to perform operations within the wellbore; selecting, by the second control unit, to which of a plurality of downhole tools a signal should be sent; transmitting, by the second control assembly, at least a portion of the instructions to at least one of the plurality of downhole tools.

Systems and methods can include one or more of the following features.

In some embodiments, the second control unit is configured to receive a signal from the first control unit and determine to which of the plurality of downhole sub-assemblies to send a signal.

In some embodiments, the first control unit includes: one or more processors; and a computer-readable medium storing instructions executable by the one or more processors to perform operations including: receiving, from a surface of the wellbore, instructions to perform operations within the wellbore; and transmitting, to at least one of the plurality of sub-assemblies, at least a portion of the instructions. In some cases, the operations further include: receiving, from at least one of the plurality of sub-assemblies, status signals representing a status of the at least one of the plurality of sub-assemblies; and transmitting, to the surface of the wellbore, the status signals. The status signals can include a state of a sub-assembly, the state including either an on state or an off state. The system can further include: one or more transmitters at the surface of the wellbore, the one or more transmitters configured to transmit the instructions to the one or more processors; and one or more receivers at the surface of the wellbore, the one or more receivers configured to receive the status signals from the one or more processors.

In one embodiment, the system includes one or more repeaters configured to be positioned between the surface and the bottom hole assembly within the wellbore, the one or more repeaters configured to boost a strength of a wireless signal between the one or more transmitters or the one or more receivers and the one or more processors.

In some embodiments, the first control unit further includes a power source configured to provide operating power to the one or more processors.

In some embodiments, the control sub-assembly is a first control sub-assembly and the system further includes a second control sub-assembly including a first control unit and a second control unit.

Some methods include: transmitting, by the at least one of the plurality of sub-assemblies to the second control assembly, status signals representing a status of the at least one of the plurality of sub-assemblies; and receiving, by the first control assembly, the status signals from the at least one of the plurality of sub-assemblies. In some cases, methods include transmitting, by the first control assembly to the surface of the wellbore, the status signals from the at least one of the plurality of sub-assemblies.

Advantages of the system include the ability to communicate information between the surface and downhole wirelessly, without mud pulse telemetry. In addition, this technology can keep full communication while drilling depleted reservoir zones or fracture zones that induce large fluid losses to the formation. Such losses affect the quality of mud pulse signals but do not affect the described systems that use WI-Fi communication. Loss of fluid to the formation can also cause plugging of the formation by the lost circulation material. By avoiding weak signal and plugging issues, these systems and methods also can reduce the rig/well time spent for communicating with downhole devices during drilling operations. In addition, these wireless systems free drilling engineers to place downhole drilling tools in different places by reducing limitations regarding downhole drilling equipment position.

These systems and methods can improve the drilling process performance and enhances safety in oil and gas wells having hydrogen sulfide concentrations. The use of Wi-Fi communication avoids the need for a sensor in contact with drilling and/or completion fluid. For example, an associated sensor can be attached to the standpipe that the drilling and/or completion mud goes through. This approach limits the exposure of personnel to fluids that maybe contaminated with hydrogen sulfide.

The details of one or more embodiments of the systems and methods are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

The technology relates to a downhole wellbore communication tool that provides wireless communication between downhole well operation tools and the surface. The tool passes wellbore information from downhole well operation tools to the surface and passes signals and commands to the downhole well operation tools. The communication tool is compact and can be mounted to various parts of a bottom hole assembly or drill string.

Some communication tools include a master control unit and a second (or auxiliary) control unit. The master control unit includes a processor with a transmitter and a receiver, and is coupled to a memory device. The second control unit also includes a processor with a transmitter and a receiver, and is coupled to a memory device. The processors of both units are powered by a stand-alone power source or sources, for example, a lithium battery. In addition to receiving and transmitting data between the downhole well operation tools and the surface, each processor can deliver a diagnostic of the well tools in real time and can identify points of failure.

The system has two control units, each including a processor, a transmitter, a receiver, and a memory. The uphole or master control unit is wirelessly coupled to surface computers. The downhole or secondary control unit is wirelessly coupled to various downhole tools. The two control units are coupled to each other and are powered using a battery or batteries. The secondary control unit receives well information from the downhole tools and transmits information to the master control unit. The master control unit organizes the information in a standard telemetry sequence, and in turn sends the information to the surface.

Figure 1:
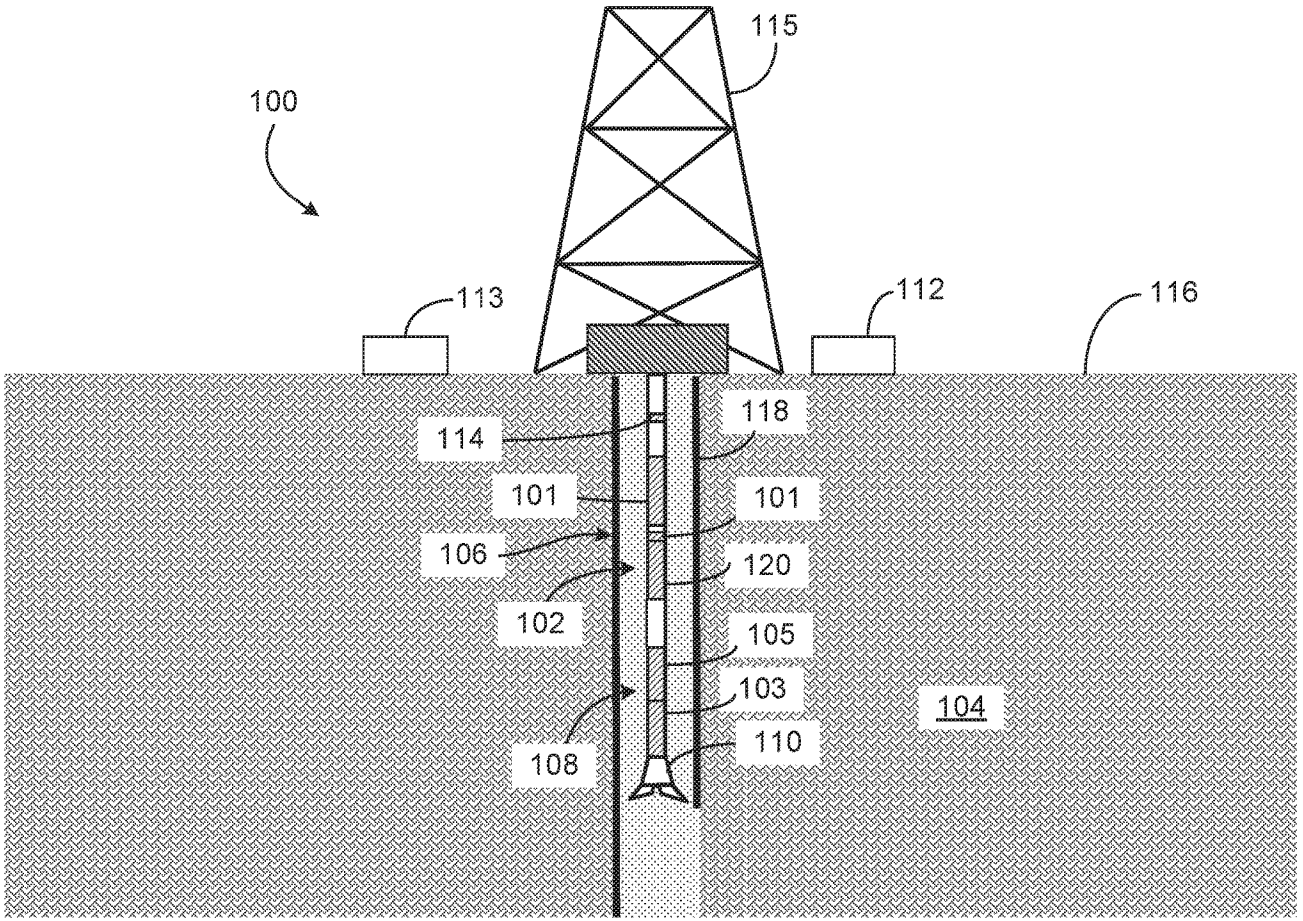
FIG. 1 is a schematic diagram of a wellbore drilling system.

FIG. 1 shows an example wellbore drilling system 100 being used in a wellbore 106. The wellbore drilling system 100 can be used in forming vertical, deviated, and horizontal wellbores. The well drilling system 100 includes a drill derrick 115 that supports the weight of and selectively positions a drill string 108 in the wellbore 106. The drill string 108 has a downhole end connected to a drill bit 110 that extends the wellbore 106 in the formation 104. Once drilled, the wellbore 106 is provided with a casing 118 that provides additional strength and support to the wellbore 106. The wellbore drilling system 100 includes a bottom hole assembly (BHA) 102. The BHA 102 can include a measurement while drilling (MWD) sub 120. These systems can also be used with other equipment such as, for example, cleanout tools, rotary steerable systems, and logging while drilling subs.

The BHA 102 also includes a control assembly 101 mounted on and carried by the BHA 102. The control assembly 101 is designed to be deployed in the wellbore 106 and is configured to handle shock-loads, other vibrations, high temperatures, hydrogen sulfide, corrosive chemicals, or other potential downhole hazards. The control assembly 101 communicates with multiple downhole well operation tools 103, 105 that are mounted on the BRA 102. The tools can be located above or below the control sub.

The wellbore drilling system 100 includes one or more transmitters 112 at or near the surface 116. The one or more transmitters 112 are operable to transmit communications such as, for example, operation instructions to the control assembly 101. In addition to the transmitters 112, one or more receivers 113 are positioned at or near the surface 116. The one or more receivers 113 are operable to receive one or more status signals from the control assembly 101. The transmitter(s) 112 and the receiver(s) 113 communicate wirelessly with the control assembly 101. In some implementations, the wireless communication include radio frequency communication, such as Wi-Fi. In some implementations, the transmitters and receivers are located near (for example, above or below) the surface of the ground as stand-alone units or mounted on other components of the drilling system.

The wellbore drilling system 100 includes repeaters 114 positioned between the surface 116 and the BHA 102 within the wellbore 106. The repeaters 114 can boost a strength of a wireless signal between the one or more transmitters 112 or the one or more receivers 113 and the control assembly 101. Some wellbore drilling systems are implemented without repeaters 114.

Figure 2:
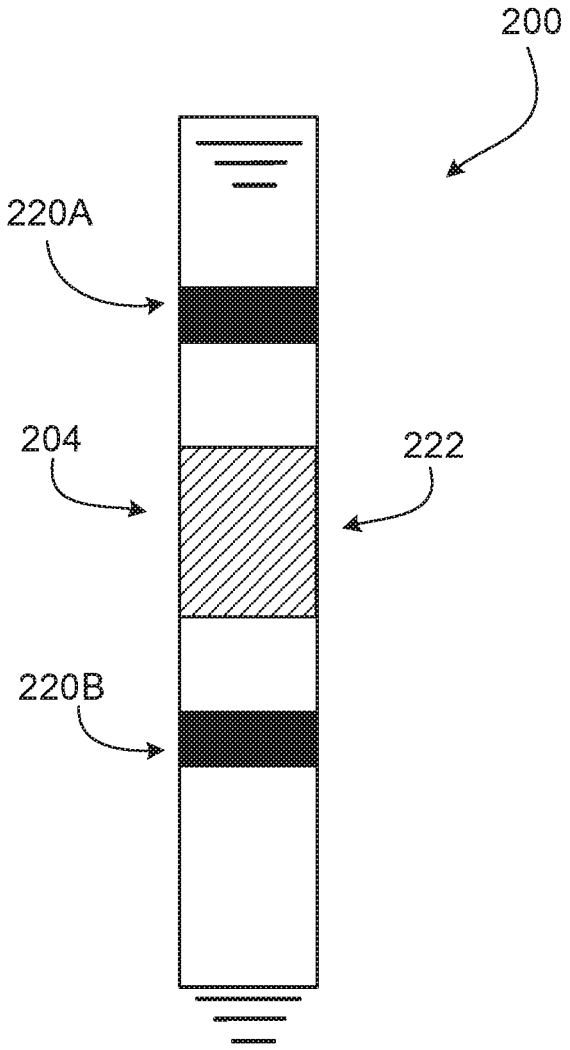
FIG. 2 is a schematic of a control sub for use in a wellbore drilling system.

FIG. 2 shows a communication tool 200 which is part of the control assembly 101 that can be included as part of the BHA 102. For example, the communication tool can be part of control assembly 101. The communication tool 200 has a sub body 204 that attaches to the drill string in a conventional manner. Currently, the MWD or communication subs are located at the BHA. In contrast, the new control sub can be used at other locations in the drill string such as, for example, above the BHA in the drill pipes. The communication tool 200 communicates with various sub-assembly tools downhole to activate and de-activate them. The communication tool 200 includes a master control unit 220A, a secondary control unit 220B, and a battery 222. The communication tool also includes memory and a processor (not shown). Each control unit 220A, 220B includes one or more transmitters and receivers. In some applications, these transmitters and receivers provide real-time communication between the communication tool and the surface delivering, for example, information regarding the functioning of the downhole tools to the surface and commands to the downhole tools.

Figure 3:
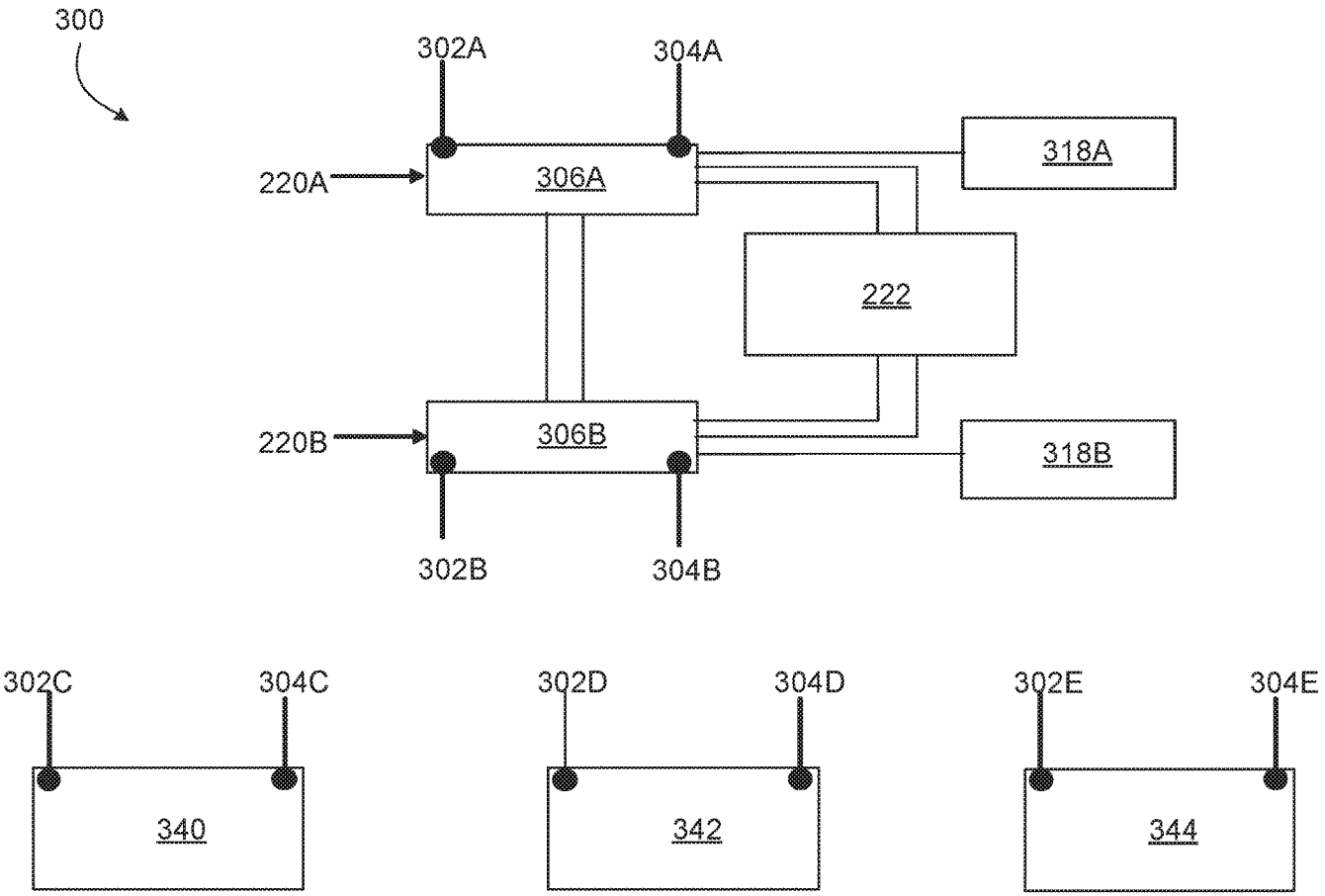
FIG. 3 shows a block diagram of an example control system of the control sub.

FIG. 3 shows a block diagram 300 of the components of the communication tool 200 which includes the master control unit 220A and the secondary control unit 220B. The master control unit 220A is the interface between the communication tool and the surface while the secondary control unit 220B is the interface between the communication tool 200 and downhole equipment.

The master control unit 220A is operable to coordinate information transfer with the surface and to receive and delivery desired information to the secondary control unit 220B. The secondary control unit 220B is operable to coordinate information transfer with downhole equipment. The communication tool 200 is configured with wired communication between the master control unit 220A and the secondary control unit 220B. In some tools, the master control unit 220A and the secondary control unit 220B communicate with each other wirelessly instead of or in addition to such wired communication channels.

The master control unit 220A includes one or more processors 306A and a computer-readable medium 318A storing instructions executable by the one or more processors 306A to perform operations. The master control unit 220A also includes a transmitter 302A and receiver 304A operable to communicate with the surface 116. For example, after receiving instructions to perform operations within the wellbore, the master control unit can process and organize the instructions before relaying the instructions to the secondary control unit 220B. This processing and organizing can include identifying which tool will receive the desired information when the information is sent in a pre-setting sequence for different tools. This approach accounts for each tool having different function in the drill string and needing different configurations or modifications. The master control unit 220A also receives signals representing a status of the downhole tools, 340, 342, 344 from the secondary control unit 220B. The transmitter 302A can transmit the status signals to the surface 116. The processors 306A of the master control unit 220A organize information being transferred to the surface in a standard telemetry sequence in organized packages to be interpreted by field personnel. The status signals can include a state of the downhole tools such as, for example, an "on" state or an "off" state and the operational status of each tool such as, for example, leaks, temperature, and functionality.

Communication tools also include a power source or sources. The communication tool 200 has a single power source 222. The power source 222 is operatively coupled to and provides operating power to the master control unit 220A and the secondary control unit 220B. In some implementations, communication tools include multiple power sources (for example, each control unit powered by a separate battery). In some implementations, the power source is a lithium ion battery.

The secondary control unit 220B includes one or more processors 306B and a computer-readable medium 318B storing instructions executable by the one or more processors 306B to perform operations. The secondary control unit 220B also includes a transmitter 302B and receiver 304B operable to communicate with downhole equipment such as downhole tools 340, 342, 344. After receiving information from the master control unit 220A, the secondary control unit 220B determines to which of the plurality of downhole tools the signal should be sent. For example, the secondary control unit 220B determines for which of the downhole tools 340, 342, 344 the information is intended before relaying the instructions. After receive the information, the control sub can submit the desired command to different tools located across the drill string. The signal switch a specific tool between on and off states as well as sending different information for different tools at the same time.

The receiver 304B receives status signals representing a status of the downhole tools 340, 342, 344. The secondary control unit 220B can also transmit the status signals to the surface 116 via the master control unit 220A. The status signals can include a state of a communication assembly (such as an "on" state or an "off" state).

The communication tool 200 send signals to downhole tools 340, 342, 344. Each tool 340, 342, 344 has a respective receiver 304C, 304D, 304E that can be used to receive instructions from the second control unit transmitter 302B. Those instructions may be to perform operations within the wellbore. Each tool has a respective transmitter 302C, 302D, 302E that can transmit status signals representing a status of the respective downhole tool to the receiver 304B of the secondary control unit 220B. The secondary control unit 220B communicates the status signals to the surface 116 via the master control unit 220A. The status signals can include a state of each downhole tool (such as an "on" state or an "off" state).

In the case where a downhole tool 340, 342, 344 cannot communicate with the surface (for example, failure of the one or more processors 306A), communication is interrupted between the surface 116 and downhole drilling tools. However, if processor 306B is still functioning, it continues collecting and storing the information on computer-readable medium 318B. That stored information is processed when the communication tool 200 arrives at the surface 116, at which time the computer-readable medium 318B memory is downloaded to a surface computer and interpreted. The processor can be set to automatically collect and save data. For example, all communications and data received from tools can be saved in the memory in a sequence that they arrive.

In some embodiments, the method includes automatically maintaining the system functions based on pre-determined limits work. This functionality can be provided, for example, by pre-calibrating equipment on the surface to deliver certain limits or results. For example, MWD, LWD, and clean out tools can be pre-programmed with a maximum size to which the arms of a stabilizer are opened when the tool receives a signal to activate the stabilizer.

Figure 4A:
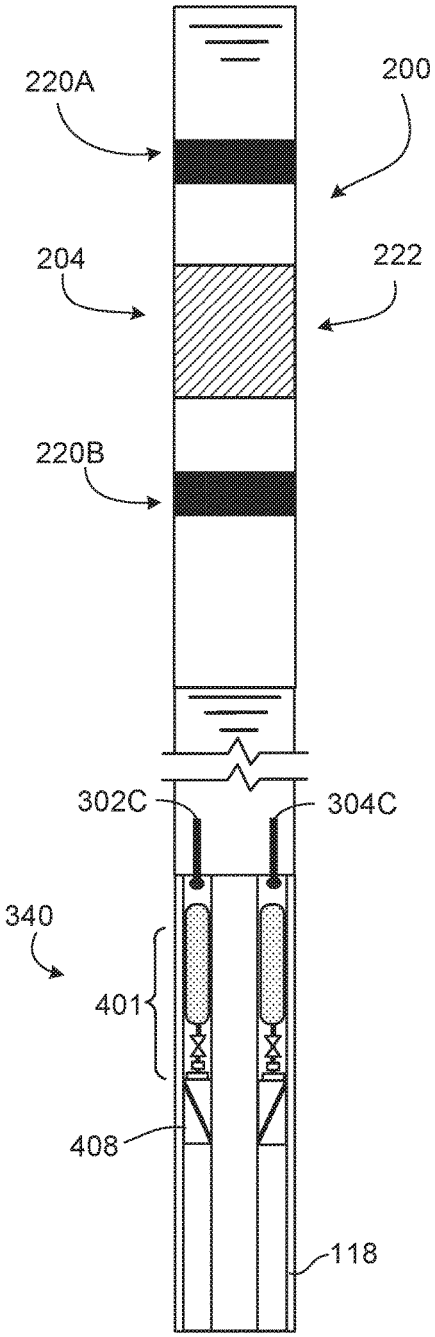
FIGS. 4A and 4B are schematic side views of a portion of an example downhole operation tool in communication with the control system.
Figure 4B:
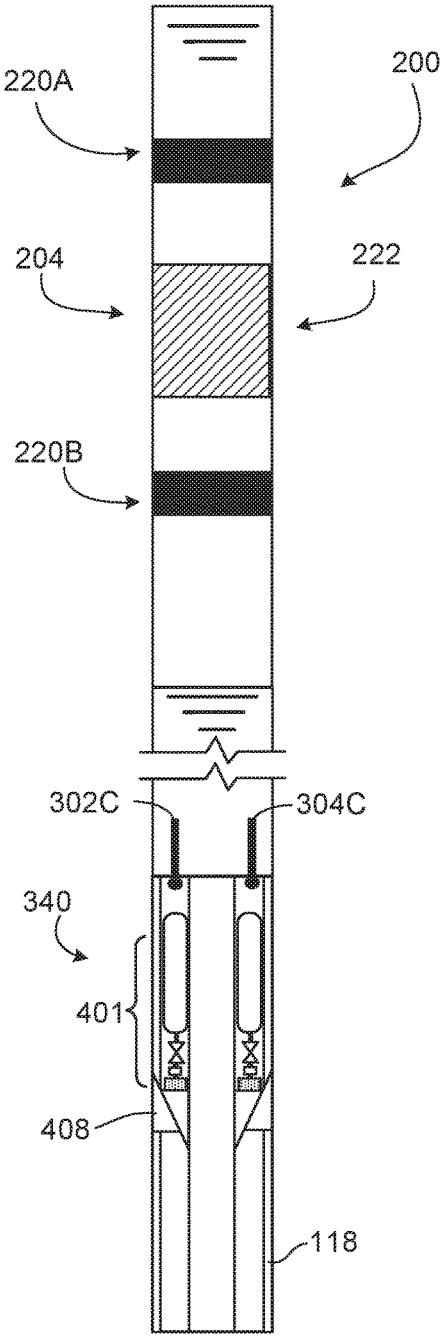

FIGS. 4A-4B show an example downhole tool 340 in communication with the secondary control unit 220B of communication tool 200. In this example, downhole tool 340 is a tool that anchors itself to the casing 118 of the wellbore 116. In FIG. 4A, anchors or slips 408 of the 340 are in a deactivated mode, while in FIG. 4B, the slips 408 of the tool 340 are in an activated mode. The tool 340 includes a hydraulic power unit 401 that acts as the activation and deactivation unit for the slips 408.

The hydraulic power unit 401 can receive at least a portion of the instructions from the secondary control unit 220B. Portions of the instructions can include changing states of a hydraulic power unit 401 to change position of the actuatable slips 408, or any other command that can be executed by the hydraulic power unit. The tool 340 receives such a signal to activate at its receiver 302C, to change its state to the activated mode (in FIG. 4B). The tool 340 may then transmit a signal of its status via its transmitter 304C.

Figure 5:
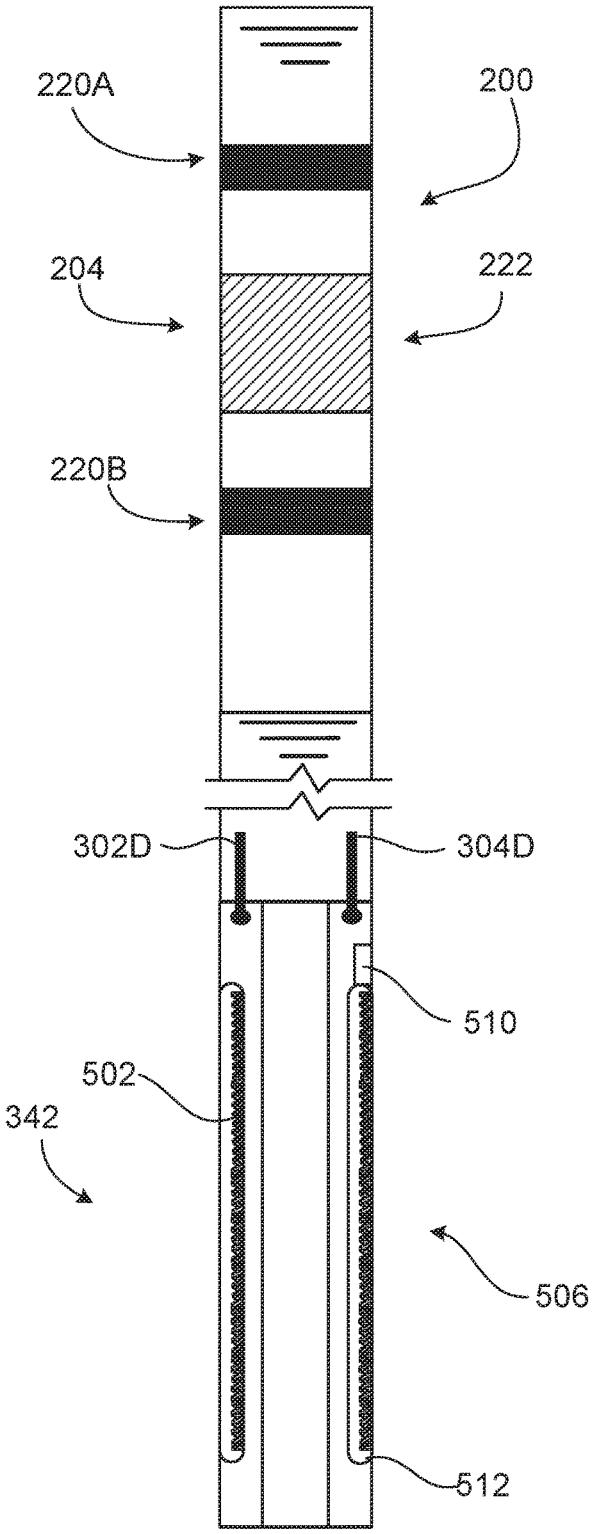
FIG. 5 is a schematic side views of a portion of an example downhole operation tool in communication with the control system.

FIG. 5 shows a cross-sectional view of a second example downhole tool 342 in the form of a magnetic sub-assembly 506 in communication with the secondary control unit 220B of communication tool 200. The magnetic sub-assembly 506 includes electromagnetic coils 502 within electromagnetic bars 512. The electromagnetic coils 502 and electromagnetic bars 512 are activated when a signal is received from the secondary control unit 220B at the receiver 302D of the tool 342. The electric power supplied to the electromagnetic coils 502 creates a magnetic field in the electromagnetic coils 502 and to the electromagnetic bars 512. The electromagnetic coils 502 can remain energized during a well trip so that any ferrous debris collected by the magnetic sub-assembly 506 can be removed from the wellbore 106 and brought to the surface 116. The magnetic sub-assembly 506 also includes sensors 510 to detect a status of the magnetic sub-assembly 506 and relay that information back to secondary control unit 220B, via transmitter 304D. The information relayed can include current draw or temperature at the magnetic sub-assembly 506.

Figure 6:
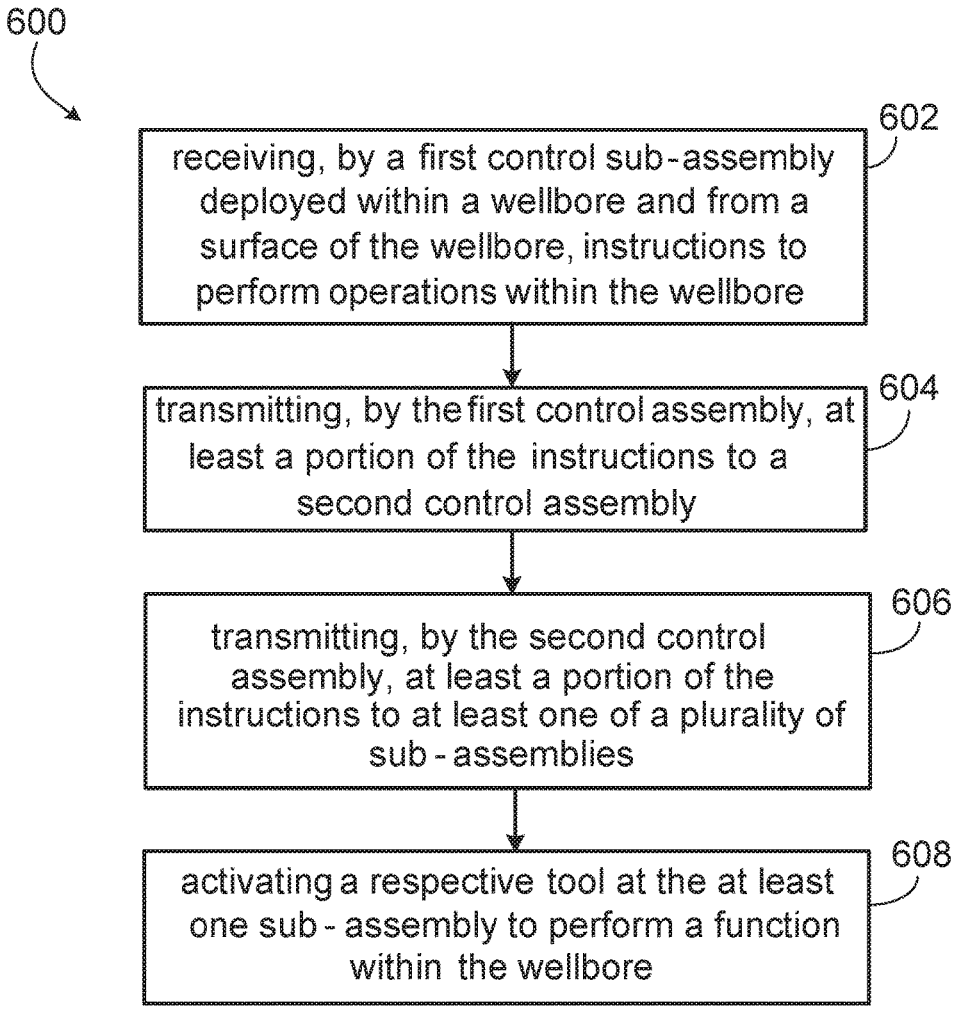
FIG. 6 is a flowchart showing an example method of controlling downhole tools with the control sub.

FIG. 6 shows a flowchart of an example method 600 used for the wellbore drilling system. At 602, instructions to perform wellbore operations within the wellbore are received from a surface 116 by a control assembly deployed within the wellbore 106. The control assembly receives these instructions from the surface or the MWD sub via the receiver installed in the control assembly.

At 604, at least a portion of the wellbore instructions is transmitted by the control assembly to the second control assembly. The second control assembly analyzes and identifies which downhole tool to activate and sends the signal to the respective tool, step 606.

At 608, a respective tool element is activated within the wellbore. Each tool can be activated independently. Additionally, status signals representing a status of the at least one of the tools is transmitted by to the control assembly and then the control assembly. The status signals from the at least one of downhole assemblies is received at the surface.

The described systems can communicate with multiple tools at the same time. The number of tools will be limited due the capacity of the processor and memory. In some approaches, methods include identifying data needs for particular tools and choosing tools based on the capacity of the processor and memory. Similarly, the available downhole time for battery-powered systems can be limited by available power. For these systems, methods can include monitoring battery status of the control sub and controlling transmissions and other activity of the control sub based on battery state and the number of tools being controlled. In addition, methods can include setting the control sub to power on after a certain time, without need to send a command from the surface after being deployed in an inactive state.

While this specification contains many specific implementation details, these should not be construed as limitations on the scope of what may be claimed, but rather as descriptions of features specific to particular implementations of particular systems or methods. Certain features that are described in this specification in the context of separate implementations can also be implemented in combination in a single implementation. Conversely, various features that are described in the context of a single implementation can also be implemented in multiple implementations separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

A number of embodiments have been described. Nevertheless, it will be understood that various modifications may be made without departing from the spirit and scope of the disclosure. For example, although the system is described as being wireless, it can include wired communication between at least parts of the system. Accordingly, other embodiments are within the scope of the following claims.

What is claimed is:

1. A wellbore communication system comprising:

a control sub-assembly comprising a body configured to be attached to a drill string, the body including a first control unit and a second control unit;

the first control unit comprising a first processor, a first transmitter, a first receiver and a first memory, the first control unit operable to send and receive wireless signals from the surface;

the second control unit comprising a second processor, a second transmitter, a second receiver and a second memory, the second control unit operable to send and receive wireless signals from the first control unit; and one or more downhole sub-assemblies interchangeably mounted on and carried by a bottom hole assembly, each of the one or more downhole sub-assembly configured to wirelessly send and receive signals from the second control unit, wherein the first control unit is configured to organize information received from the one or more downhole sub-assemblies, organize the information in a standard telemetry sequence, and send it to the surface.

2. The system of claim 1, wherein the second control unit is configured to receive a signal from the first control unit and determine to which of the plurality of downhole sub-assemblies to send a signal.

3. The system of claim 1, wherein the first control unit comprises:

one or more processors; and a computer-readable medium storing instructions executable by the one or more processors to perform operations comprising:

receiving, from a surface of the wellbore, instructions to perform operations within the wellbore; and transmitting, to at least one of the plurality of sub-assemblies, at least a portion of the instructions.

4. The system of claim 3, wherein the operations further comprise:

receiving, from at least one of the plurality of sub-assemblies, status signals representing a status of the at least one of the plurality of sub-assemblies; and transmitting, to the surface of the wellbore, the status signals.

5. The system of claim 4, wherein the status signals comprise a state of a sub-assembly, the state comprising either an on state or an off state.

6. The system of claim 5, further comprising:

one or more transmitters at the surface of the wellbore, the one or more transmitters configured to transmit the instructions to the one or more processors; and one or more receivers at the surface of the wellbore, the one or more receivers configured to receive the status signals from the one or more processors.

7. The system of claim 1, further comprising one or more repeaters configured to be positioned between the surface and the bottom hole assembly within the wellbore, the one or more repeaters configured to boost a strength of a wireless signal between the one or more transmitters or the one or more receivers and the one or more processors.

8. The system of claim 1, wherein the first control unit further comprises a power source configured to provide operating power to the one or more processors.

9. The system of claim 1, wherein the control sub-assembly is a first control sub-assembly and the system further comprises a second control sub-assembly comprising a first control unit and a second control unit.

10. A method of controlling wellbore operations, the method comprising:

receiving, by a first control unit deployed within a wellbore and mounted to a sub body and from a surface of the wellbore, instructions to perform operations within the wellbore;

transmitting, by the first control assembly, at least a portion of the instructions to a second control unit downhole of the first control unit, the second control unit mounted to the sub body;

receiving, by the second control unit, instructions to perform operations within the wellbore;

selecting, by the second control unit, to which of a plurality of downhole tools a signal should be sent; and transmitting, by the second control assembly, at least a portion of the instructions to at least one of the plurality of downhole tools.

11. The method of claim 10, further comprising:

transmitting, by the at least one of the plurality of sub-assemblies to the second control assembly, status signals representing a status of the at least one of the plurality of sub-assemblies; and receiving, by the first control assembly, the status signals from the at least one of the plurality of sub-assemblies.

12. The method of claim 11, further comprising transmitting, by the first control assembly to the surface of the wellbore, the status signals from the at least one of the plurality of sub-assemblies.

* * * * *